US005244424A

United States Patent [19]

Hessey

[11] Patent Number: 5,244,424

[45] Date of Patent: Sep. 14, 1993

[54] ELECTRICAL COUPLINGS AND SYSTEMS

[75] Inventor: Alan Hessey, Henley-on-Thames, England

[73] Assignee: Smiths Industries Public Limited Company, London, England

[21] Appl. No.: 913,159

[22] Filed: Jul. 14, 1992

[30] Foreign Application Priority Data

Aug. 1, 1991 [GB] United Kingdom ..... 9116730

[51] Int. Cl.[5] ..... H01R 4/42

[52] U.S. Cl. ..... 439/863; 439/774

[58] Field of Search ..... 439/772, 773, 774, 863, 439/864, 760, 764, 761

[56] References Cited

U.S. PATENT DOCUMENTS

| | | | |
|---|---|---|---|
| 928,857 | 7/1909 | Donnelly | 439/864 |
| 1,698,629 | 1/1929 | Haley et al. | 439/773 |
| 1,756,445 | 4/1930 | Walde | 439/764 |
| 2,730,691 | 1/1956 | Nelson | 439/773 |
| 3,205,472 | 9/1965 | Shannon | 439/764 |
| 3,369,215 | 2/1968 | Halgert | 439/764 |
| 3,602,871 | 8/1971 | Newman | 439/724 |
| 4,039,238 | 8/1977 | Johnson, Jr. et al. | 439/843 |
| 4,120,557 | 10/1978 | Horrocks | 439/843 |
| 5,100,348 | 3/1992 | Herman et al. | 439/724 |

FOREIGN PATENT DOCUMENTS

| | | | |
|---|---|---|---|
| 237644 | 6/1960 | Australia | 439/864 |
| 476632 | 9/1951 | Canada | 439/773 |
| 555257 | 9/1958 | Italy | 439/773 |
| 292214 | 1/1954 | Switzerland | 439/863 |
| 323420 | 1/1930 | United Kingdom | 439/864 |

*Primary Examiner*—Gary F. Paumen

*Attorney, Agent, or Firm*—Pollock, Vande Sande and Priddy

[57] ABSTRACT

An electrical coupling for a power supply busbar has a U-shape metal body that embraces the busbar and is locked in place by a pin that extends through apertures in opposite limbs of the body. The pin has a shoulder that urges the bar against a flexible metal strip retained in a groove in the body. A plastics sleeve embraces the body and retains the pin in place, the sleeve being retained by a cable stud screwed into the body.

6 Claims, 2 Drawing Sheets

ELECTRICAL COUPLINGS AND SYSTEMS

BACKGROUND OF THE INVENTION

This invention relates to electrical couplings and systems.

The invention is more particularly concerned with couplings for making connection to an electrical conductor such as a busbar serving as a power supply rail.

In some applications, such as in some vehicle power supply systems, a pair of solid metal rods or busbars are connected to opposite terminals of a power supply. Electrical power is tapped off the bars at different points, for supply to different equipment, by means of couplings attached to the bars. Because of the high currents often involved, the couplings must make good electrical contact to ensure that resistance heating is kept to a minimum. The couplings are preferably also capable of being mounted readily on the busbars and removed from them to allow for maintenance, replacement or the addition of extra equipment. The couplings should also be robust and capable of withstanding vibration.

SUMMARY OF THE INVENTION

It is an object of the present invention to provide a coupling for mounting on a bar, and a system including such a coupling.

According to one aspect of the present invention there is provided an electrical coupling for mounting on a metal bar comprising a rigid metal body having a pair of opposite limbs adapted closely to embrace opposite sides of the bar, the limbs being separate from one another at one end and linked together at their opposite end by a contact region shaped to conform to the surface of the bar, the coupling including a flexible metal strip located in the contact region adapted to contact the body on one side and the bar on its other side, and locking means for locking the coupling on the bar.

The locking means preferably comprises a pin and an aperture in both limbs in which the pin is located. The pin may have a shoulder that engages the bar and urges it towards the metal strip when the pin is inserted in the apertures. The coupling preferably includes an electrically-insulating sleeve which embraces the body and retains the pin in the apertures. The metal body may be of part circular section. The coupling may be adapted for mounting on a bar of circular section, the contact region being of semicircular shape. The metal body may have a groove along the contact region, the flexible metal strip being located in the groove. The flexible metal strip preferably has a plurality of laterally projecting fingers along opposite edges. The metal body may have a threaded aperture, the coupling including a threaded stud secured in the threaded aperture and the stud being connected to a flexible cable.

According to another aspect of the present invention there is provided an electrical system including a power supply, at least one metal bar connected to the power supply, and at least one electrical coupling according to the above one aspect of the present invention.

A coupling and a vehicle power supply system according to the present invention, will now be described, by way of example, with reference to the accompanying drawings.

DESCRIPTION OF THE PREFERRED EMBODIMENTS

Figure 1:
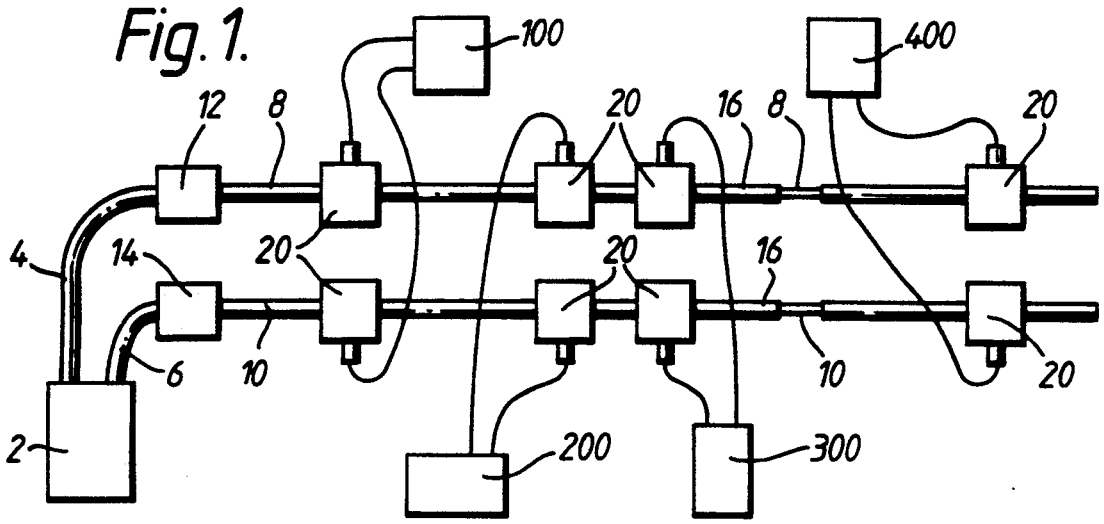
FIG. 1 shows the system schematically.
Figure 2:
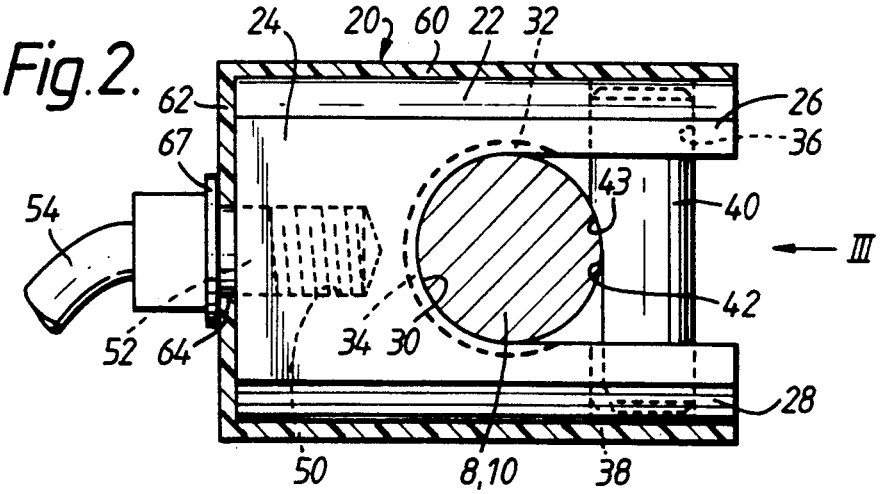
FIG. 2 is a partly sectional, side elevation view of the coupling.

With reference first to FIG. 1, the system includes a power supply unit 2 which has positive and negative output leads 4 and 6 connected to one end of respective busbars 8 and 10 by means of conventional couplings 12 and 14. The busbars 8 and 10 each take the form of a solid copper rod of circular section typically about 300cm long and 13mm in diameter. Alternatively, the busbars could be hollow tubes where lower currents are required. Along the length of each busbar there is an insulating sleeve 16 of a plastics material. As shown, the system includes four take-off contacts or couplings 20 on each busbar which are identical with one another. The couplings 20 serve to supply power from the busbars 8 and 10 to four different items of equipment 100, 200, 300 and 400.

Figure 3:
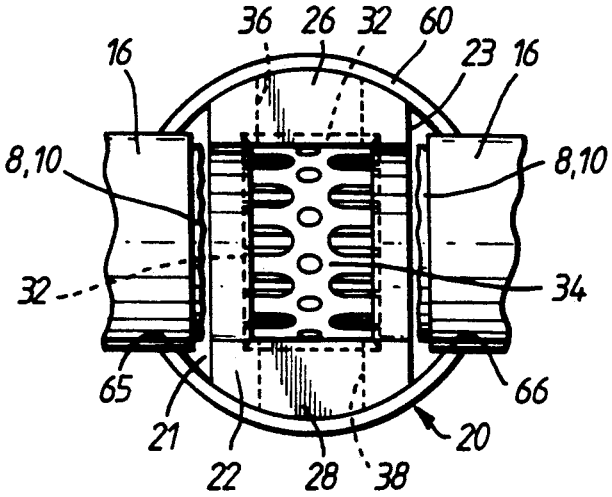
FIG. 3 is a view of the coupling from one end, along the arrow III of FIG. 2, with the locking pin omitted and the busbar cut away for clarity.
Figure 4:
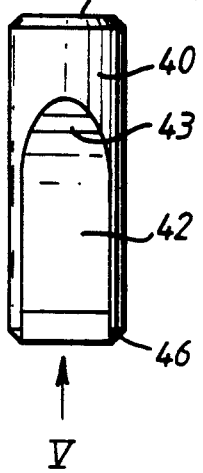
FIG. 4 is a side view of a locking pin used in the coupling.
Figure 5:
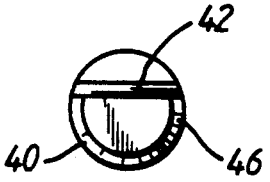
FIG. 5 is a view from below of the pin shown in FIG. 4, along the arrow V.
Figure 6:
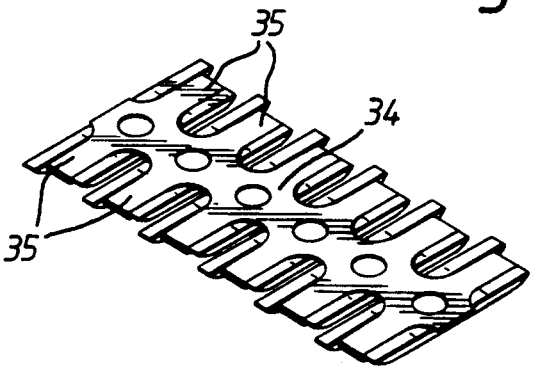
FIG. 6 is a perspective view a metal strip used in the coupling.

Referring now to FIGS. 2 to 6, the coupling 20 comprises a solid brass block 22 of U-shape having a base portion 24 from which extend two parallel limbs 26 and 28. Alternative metals, such as copper, could be used for the block 22. The length of the block 22, is 35mm and its width 23mm, the two limbs 26 and 28 being spaced from one another by the diameter of the busbars 8 and 10, that is, 13mm. As seen in FIG. 3, the external surface of the block is part cylindrical with two parallel longitudinal flats 21 and 23 and with the external surface of the limbs 26 and 28 having a convex curvature along their length. The base portion 24 has a contact region 30 linking the two limbs which is of semicircular shape and has formed around it an undercut groove 32 about 9mm wide. The shape of the contact region 30 is chosen to conform to the surface of the busbars. Within the groove 32 there is located a flexible metal contact strip 34, as shown in greater detail in FIG. 6. The strip 34 is available from Sotax A. G. under catalogue number 8-0.2Ag and comprises a beryllium substrate coated with silver. The strip is ribbed laterally and has laterally projecting fingers 35 along opposite edges which locate within the undercut of the groove 32 on opposite sides. The dimensions of the groove 32 and strip 34 are such that the strip can be slipped into the groove from one end and is held in place by friction and by contact with the busbar, once the coupling is assembled on the busbar.

Towards the free end of each limb 26 and 28 there is formed a circular aperture 36 and 38 respectively of diameter about 8mm which align with one another across the gap between the limbs. The apertures 36 and 38 serve to receive a locking pin 40 as shown in FIGS.

4 and 5. The pin 40 is of 316 stainless steel and is of circular section apart from a flat 42 formed towards its lower end and a sloping shoulder 43 between the flat and the circular part of the pin. The pin 40 is 23mm long and 8mm in diameter with bevelled ends 44 and 46. The location of the apertures 36 and 38 and the shape of the pin 40 is such that the flat 42 contacts one side of the busbar 8, 10 and urges it towards the contact region 30 and the metal strip 34.

The left hand end of the base portion 24 is flat and is formed centrally with a tapped hole 50. Into this hole 50 is screwed a threaded stud 52 which is electrically connected to a flexible cable 54 which extends to the respective equipment 100, 200, 300 or 400. It will be appreciated that there are alternative ways in which the cable 54 could be connected to the brass block 22 such as a quick release pin or socket connector which may be an integral part of the block.

The flexible metal strip 34 conforms to the shape of the busbar 8, 10 on one surface and conforms to the groove 32 on the other surface. Insertion of the pin 40 ensures close contact of the busbar with the strip 34 and close contact of the strip with the floor of the groove. This provides a good electrical contact between the busbar and the block and hence good connection with the cable 54.

The pin 40 is retained in position by means of a sleeve 60 of an electrically-insulating plastics material. The sleeve 60 is of cylindrical shape and circular section with an internal diameter that is a close fit on the outside of the block 22. At its right-hand end the sleeve 60 is open; at its left-hand end the sleeve is closed by a flat end cap 62 having a central aperture 64 of the same size and in alignment with the hole 50 in the block 22. The sleeve 60 has two slots 65 and 66 on opposite sides which extend to the right-hand end of the sleeve and through which the busbar 8, 10 projects. A washer 67 overlies the end cap 62 of the sleeve 60 which is engaged by the stud 52 so that the sleeve 60 is retained in position. In addition to retaining the pin 40, the sleeve 60 insulates the outside of the coupling. The size of the slots 65 and 66 in the sleeve 60 is sufficient to accommodate the insulating sleeve 16 on the busbars 8, 10 so that this can extend into the spaces within the sleeve 60 between each flat 21 and 23. In this way, the sleeve 60 overlaps the insulation 16 on the busbars. In a typical system, with three or four couplings, each coupling can handle about 120 to 150 amps without excessive heating, up to the maximum capacity of the busbar.

Figure 7:
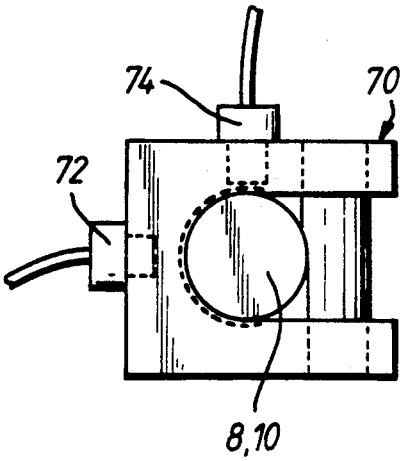
FIG. 7 is a side elevation view of an alternative coupling.

Various modifications are possible to the coupling. For example, as shown in FIG. 7, the coupling 70 could have more than one take-off 72 and 74 one of which 74 could be located on the side of the coupling. It will be appreciated that an aperture or slot would need to be provided in the sleeve to allow access of the take-off 74.

Figure 8:
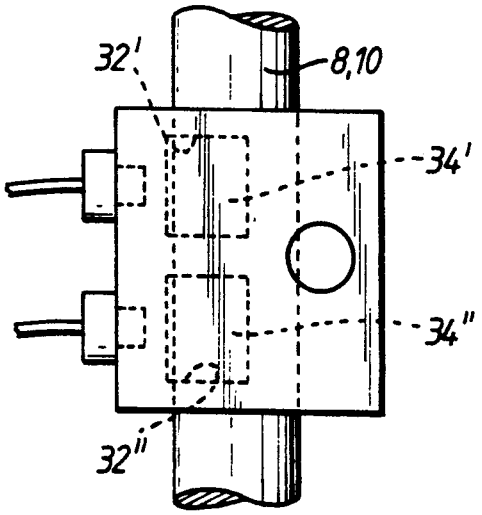
FIG. 8 is a plan view of an alternative coupling.

In another modification, as shown in FIG. 8, the area of contact with the busbar 8, 10 is increased by the use of two flexible strips 34' and 34" which are located in their own respective grooves 32' and 32". The grooves 32' and 32" are spaced from one another along the busbar. By increasing the contact area, there is an increase in the amount of power that can be drawn at a single location, without causing excessive heating.

What I claim is:

1. An electrical coupling for mounting on a metal bar of circular cross section comprising: a rigid metal body having a pair of opposite parallel limbs and a contact region, the limbs being shaped closely to embrace opposite sides of the bar and being separated from one another at one end by a distance substantially equal to the diameter of the bar, said limbs being linked at their opposite ends by said contact region, the contact region being of a semi-circular shape which conforms to the surface of one side of the bar; a flexible metal strip having a length substantially equal to that of said contact region, the strip having two sides and being located in the contact region so that one side of said strip contacts said body and the other side of said strip is exposed for contact with said one side of said bar and a lock comprising a pair of apertures in said pair of limbs respectively and a pin extending between said apertures and across said limbs, said pin having a shoulder that engages said bar and urges said bar toward said metal strip solely upon insertion of said pin along its length into said apertures.

2. A coupling according to claim 1, wherein the coupling includes an electrically-insulating sleeve, which embraces said body and retains the pin in said apertures.

3. A coupling according to claim 1, wherein the metal body is of part circular section.

4. A coupling according to claim 1, wherein the metal body has a groove along the contact region, said flexible metal strip being located in said groove.

5. A coupling according to claim 1, wherein said flexible metal strip has a plurality of laterally projecting fingers along opposite edges the strip.

6. A coupling according to claim 1, wherein the metal body has a threaded aperture, the coupling including a threaded stud secured in the threaded aperture, said stud being connected to a flexible cable.

* * * * *